US005220752A

United States Patent [19]

Cheney et al.

[11] Patent Number: 5,220,752

[45] Date of Patent: Jun. 22, 1993

[54] CONFORMABLE SANDING DEVICE INCORPORATING A FLEXIBLE ATTACHMENT MEANS

[76] Inventors: Christopher Cheney; Bryan Sharlow, both of 2 Pamela Dr., Portsmouth, N.H. 03801

[21] Appl. No.: 733,340

[22] Filed: Jul. 22, 1991

[51] Int. Cl.[5] ..... B24B 23/00

[52] U.S. Cl. ..... 51/170 R; 51/394; 51/181 R; 51/391

[58] Field of Search ..... 51/170 R, 170 MT, 394, 51/391, 392, 393, 181 R, 358, 401, 402

[56] References Cited

U.S. PATENT DOCUMENTS

| | | | |
|---|---|---|---|
| 3,089,294 | 5/1963 | Cowley | 51/392 |
| 3,129,540 | 4/1964 | Valles | 51/391 |
| 3,540,160 | 11/1970 | DeRose et al. | 51/391 |
| 5,022,189 | 6/1991 | Saul | 51/170 MT |
| 5,025,596 | 6/1991 | Heyer et al. | 51/394 |

FOREIGN PATENT DOCUMENTS

| | | | |
|---|---|---|---|
| 2620367 | 3/1989 | France | 51/393 |

*Primary Examiner*—Roscoe V. Parker
*Attorney, Agent, or Firm*—Frederick R. Cantor

[57] ABSTRACT

A conformable sanding device incorporating a flexible attachment for ready attachment to a hand or power sander. The sanding device is particularly useful for sanding contoured and other non-planar surfaces and angles. The sanding device comprises a compressible sanding block, said sanding block further comprising flat surfaces of an abrasive material; and, said sanding block further comprising a flexible attachment strap. The flexible attachment strap is designed for ready attachment to, and ready removable detachment from, a hand or power sanding machine.

4 Claims, 1 Drawing Sheet

CONFORMABLE SANDING DEVICE INCORPORATING A FLEXIBLE ATTACHMENT MEANS

BACKGROUND OF THE INVENTION

The present invention relates to sanding devices.

The present invention further relates to sanding devices incorporating attachment means.

The present invention also relates to conformable sanding devices, incorporating flexible attachment means, designed for ready attachment to and ready removable detachment from a hand or power sanding means.

It has been a long standing problem in the field of hand sanding means to create devices which possess appropriate stiffness values, enabling operators to apply even pressure and achieve evenly sanded finishes. Another major problem in this field of art relates to the manageability of hand sanding means in terms of the operators' ability to grip them. These seemingly distinct concerns have not been simultaneously addressed in any disclosures heretofore divulged.

The present invention combines solutions to these two problems by enhancing stiffness while simultaneously providing a unique flexible attachment means. However, a sanding device must also be sufficiently elastic, resilient and, in particular, conformable if all manner of surfaces, non-planar as well as planar, are to be sanded. It is necessary to provide a sanding device capable of withstanding forces and pressures applied to them by their operators without compromising the nature of the sanded finish achieved. To achieve these goals, the present invention employs a compressible medium and incorporates a unique flexible attachment means in the middle of the compressible sanding block.

When employing a sanding device, unevenly applied pressure produces an uneven finish. Attempts have been made to enhance the stiffness of sanding devices, often at the expense of comformability. The present invention addresses this two-fold problem by adding an incorporated flexible attachment means. Additionally, previous disclosures fail to provide a means for one-hundred percent coverage of all types of surfaces which require sanding, and there is no suggestion in the prior art of incorporating flexible attachment means to enhance orbital action or for ready removable attachment.

Known sanding blocks recognize the need for sufficient stiffness of body and conformability, however, no previous disclosures address the problem in the manner which the present invention does. The present invention derives both its conformability and its unique ease-of-use from the incorporated flexible attachment means extending outward and oriented co-planar with the upper and lower peripheral surfaces of the sanding block. Because the incorporated flexible attachment means overhangs both the proximate and distal ends of the sanding block, it not only enhances the rigidity of the present invention, but it also allows for easy and efficient attachment to a means for sanding and for ready detachment and reversal when one side has worn out.

Furthermore, the incorporated flexible attachment means not only allows for use of both sides, it also enhances the orbital action of the means for sanding. By virtue of the flexible attachment means and its ability to be attached to either a power or a hand means for sanding, said flexible attachment means ultimately provides for better handling of the sanding block than any previous disclosures.

The present invention is larger than those previously disclosed to cover the base of a hand means for sanding such as a palm sander. The present invention is also reversible, as the sanding block is coated on both the major upper and lower peripheral surfaces with abrasive material. This feature provides potentially for two different types of abrasive. Once again, the incorporated flexible attachment means running through and extending outward from the sanding block provides for the ready attachment, detachment and turning of the block, and also allows the operator to easily grip the sanding device or to attach it to a means for sanding. The compressible sanding block provides for universal use and is compatible with all major commercially available brands of hand and power means for sanding. No prior teachings divulge any such claims.

Additionally, the present invention has a conformability to rigidity ratio enabling the operator to sand all types of contours, curves, rounds, moldings and other non-planar surfaces. Basically, the requisite stiffness is achieved by the rigidity supplied by the unique flexible attachment means. This component of the present invention allows the operator to apply pressure to the compressible sanding block without attendant deformation. However, the unique flexible attachment means does not detract from the elasticity inherent in the compressible core of the sanding block. This allows the operator to push the sanding block into a plurality of different angular applications while maintaining the proper sanding angle. The incorporated flexible attachment means provides for this by enhancing the stiffness yet allowing for adequate flexion. Therefore, with the present invention, simultaneous sanding of intersecting planar surfaces is possible above and beyond all prior disclosures. A search of related art makes it apparent that these features have never before been combined, as they are in the present invention.

Early disclosures divulge attempts such as a flexible sanding pad, only for manual use, providing nothing to enhance the rigidity or allow for ready attachment and detachment. Abrasive articles are known with means for attachment, but no account is taken of rigidity or flexibility. Other disclosures further divulge coated abrasive pads and pads of flexible foam, designed only to protect the tools, edges during the use of the abrasive pads. Alternative disclosures include means of attaching a non-conformable sanding block to a power-driven tool by use of a magnetic mounting means. No combinations of previous disclosures contemplate the teachings of the present inventions.

The present invention overcomes the prior art problems of inadequate rigidity, inadequate orbital action and lack of ready attachment and detachment, through incorporation of the unique flexible attachment means running through and extending outward from the sanding block. Nothing previously disclosed anticipates or contemplates these improvements.

SUMMARY OF THE INVENTION

It is an objective of the present invention to provide a conformable sanding device having a unique flexible attachment means incorporated within the compressible sanding block, for ready attachment to, and ready removable detachment from, a hand or power means for sanding.

Another objective is to provide a sanding device capable of sanding all manner and angle of contoured non-planar surfaces with enhanced rigidity and efficiency.

Still another objective is to provide a sanding device capable of quick detachment from the sanding means, and reversal of the sanding block, with subsequent reattachment and ease of handling, resulting from the incorporated flexible attachment means.

The above and other objectives will become apparent in the description of the preferred embodiments.

A conformable sanding device for hand use or attachment to a power means for sanding, particularly useful for sanding contoured non-planar surfaces and angles is described. The sanding device comprises a compressible sanding block coated on the major upper and lower peripheral surfaces with an abrasive substance, and further comprises a unique flexible attachment means incorporated within the sanding block. The incorporated flexible attachment means is designed for ready attachment to and ready removable detachment from hand or power sander means.

In summary,

1. A conformable sanding device designed to be attached to a power or hand sanding means, and designed for a plurality of sanding applications, comprising:
   a compressible sanding block;
   said sanding block further comprising peripheral surfaces, having thereon an abrasive material; and
   said sanding block further comprising a flexible attachment means, designed for attachment of the sanding device to the sanding means.

2. A conformable sanding device, as described in paragraph 1, further comprising said flexible attachment means extending outward and oriented coplanar with the major upper and lower peripheral surfaces.

3. A conformable sanding device, as described in paragraph 1, further comprising said flexible attachment means, providing for ready attachment to, and ready removable detachment from, a power means for sanding.

4. A conformable sanding block device, as described in paragraph 1, further comprising said flexible attachment means providing for ready attachment to, and removable detachment from, a hand means for sanding.

5. A conformable sanding device, as described in paragraph 1, wherein enhanced orbital action of the means for sanding is obtained, through the flexible attachment means being attached to the power means for sanding.

6. A conformable sanding device, as described in paragraph 1, wherein enhanced orbital action of the means for sanding is obtained, through the flexible attachment means being attached to the hand means for sanding.

7. A conformable sanding device, as described in paragraph 1, particularly useful for sanding contours, curves, rounds, molding and other non-planar surfaces.

BRIEF DESCRIPTION OF THE DRAWINGS

In order that the present invention may be more fully and readily understood, and, further, that all the features thereof may be better appreciated, the present invention will now be described by way of preferred examples, with reference to the accompanying drawings.

DESCRIPTION OF THE PREFERRED EMBODIMENTS OF THE PRESENT INVENTION

Figure 1:
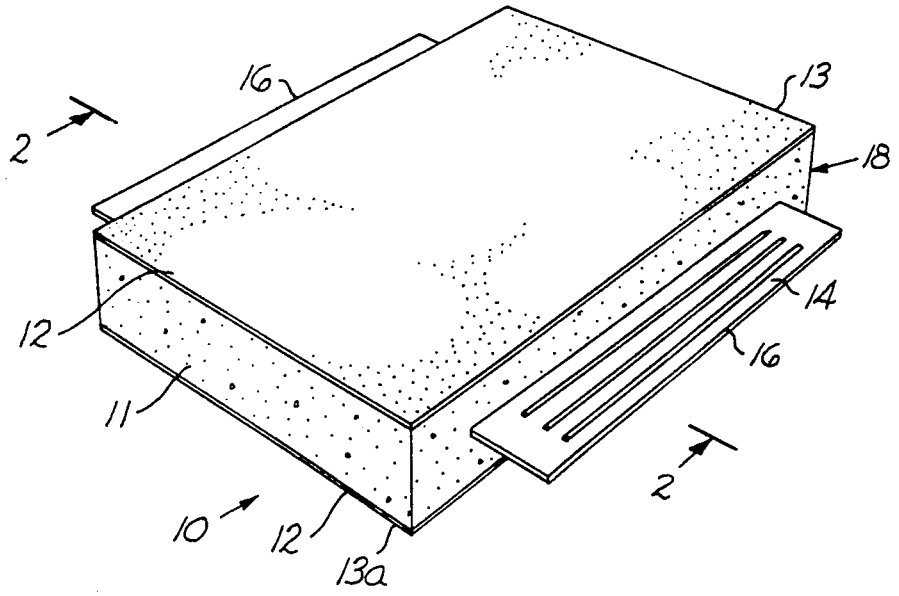
FIG. 1, is a perspective view of a conformable sanding device according to the present invention.

FIG. 1, is a perspective view of a conformable sanding device 10 according to the present invention. The sanding block 18, here depicted as rectangular, comprises a compressible core 11 which is coated with a textured abrasive substance 12, on both the major upper and lower flat faces 13 and 13A respectively. The flexible attachment strap means 14, extends outward from and overhangs both the proximate and distal side edges of the sanding block 18. Enhanced orbital action is achieved by gripping the overhanging edges 16, of the flexible attachment means 14, which also enhance the rigidity of the sanding block 18. Compressibility of the block's core material 11, provides for sanding of non-planar surfaces with a plurality of angular concave on convex contours and edges. The potential dual nature of the textured abrasive coating 12, allows the operator to turn the conformable sanding device easily and use both faces 13 and 13B. This is done by simply turning the conformable sanding device when one side is spent, or employing different types of abrasive on the major upper and lower faces, which are both readily accessible.

Figure 2:
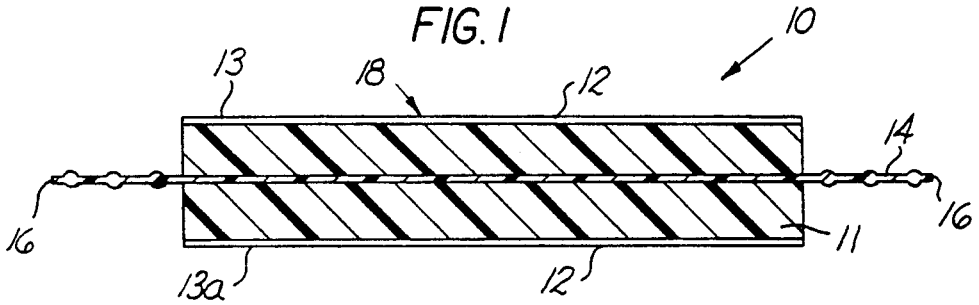
FIG. 2, is a cross-sectional view of the conformable sanding device, taken along line 2—2, as seen in FIG. 1, illustrating the flexible attachment means which is incorporated within a compressible sanding block.

The preferred embodiment of the present invention as herein illustrated in FIG. 1, comprises a flexible strap attachment means 14, being disposed approximately equidistant between the major upper and lower flat faces 13 and 13A of the sanding block 18. The major upper and lower faces, 13 and 13A, are coated with a textured abrasive substance 12, along the entire surface areas. The flexible strap attachment means 14, of the preferred embodiment is from about 1/32 to about 1/16 of an inch thick. The flexible strap attachment means 14, extends outward from and overhangs opposite side edges of the sanding block 18, by about 13/16 of an inch out of each of the ends of the sanding block 18, as depicted in the illustration of said embodiment in FIG. 1. As seen in FIG. 2, the thickness dimension of block 18 is approximately the same as the projection distance of strap 14, i.e., about thirteen-sixteenths of an inch. The block 18 thickness dimension is thus several time the thickness dimension of strap 14. The configuration and other dimensions of the sanding device may vary to suit the application, and sanding machine 20, to which the device may be attached by strap means 14.

FIG. 2, is a cross-sectional view of the conformable sanding device 10, taken at line 2—2 as seen in FIG. 1, illustrating the flexible strap attachment means 14 incorporated within said sanding block 18.

The sanding block 18, comprises a core of compressible elastic material 11, covered with a coating of abrasive substance 12 on both major faces 13 and 13A. Orbital action is enhanced by use of the overhanging edges 16, of flexible strap attachment means 14, allowing the operator to grip said device and to turn it over to use both major upper and lower faces 13 and 13A, coated with a textured abrasive substance 12. The conformability of said sanding device 10, is further enhanced by a linear (not rectangular slot numbered) cut through the sanding block 18, which incorporates the flexible strap attachment means 14. This rectangular slot in the compressible core material 11 of the sanding block 18, allows the operator to apply pressure to either of the major upper and lower surfaces 13 and 13A, without sacrificing the angle formed between the surface being sanded and the major upper or lower surfaces, 13 and 13A, making contact therewith. This feature also enables the operator to apply downward pressure while gripping the overhanging edges 16, of the flexible tongue-like strap attachment means 14, to force the flattened bottom surface 13, to conform to any number of angles, contours, or irregularly shaped non-planar surfaces. The flexible strap attachment means 14, therefore serves these dual purposes for the present invention.

Figure 3:
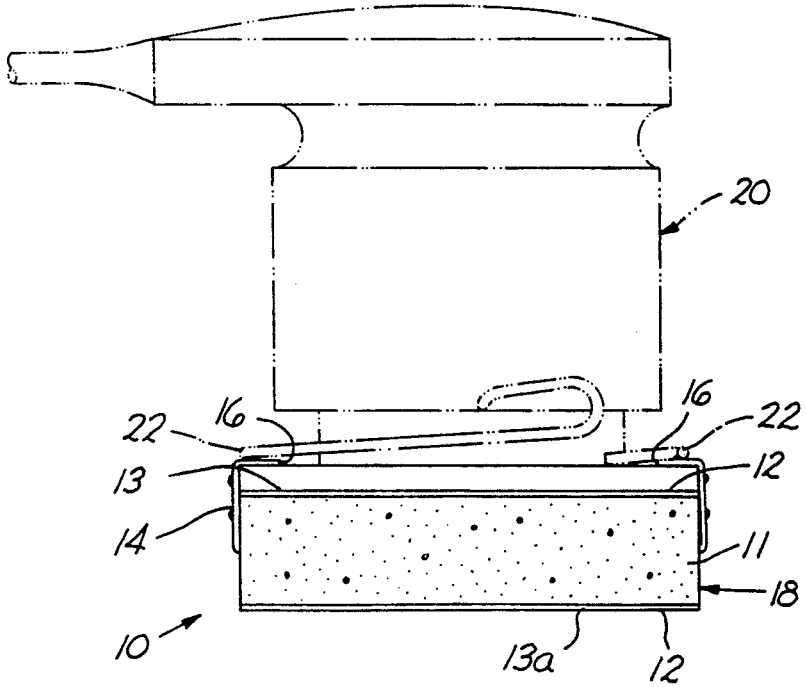
FIG. 3, shows the conformable sanding device of the present invention attached to a schematized power or hand means for sanding illustrating the flexible attachment means and its connection to the power or hand means for sanding.

FIG. 3, shows the conformable sanding device 10, attached to a schematized power or hand sanding machine 20, illustrating the flexible strap means 14, and its connection to the power or hand sanding machine 20.

The conformable sanding device 10, is coupled with said power sanding machine 20, by means of the overhanging edges 16, of the flexible strap means 14. The overhanging edges 16, of the flexible strap attachment means 14, allow the power sanding means 20, to apply the necessary orbital or rotational force to the compressible sanding block 18. This feature provides substantial improvement over any disclosures heretofore available.

Having the compressible sanding block 18, attached to the power sanding machine 20, allows for the application of an appropriate degree of downward pressure to achieve a better sanding finish. This feature applies also to any hand uses of the conformable sanding device 10, as it permits the operator of the device to apply the requisite amount and degree of pressure with no danger of slippage or of creating an unevenly sanded finish through the application of uneven pressure. The overhanging edges 16, of the flexible strap attachment means 14, thus overcome yet another common problem in the sanding means field.

Additionally, said unique flexible attachment means 14, and overhanging edges 16, are designed for ready attachment and detachment of the conformable sanding device 10. This aspect of the current invention further provides for turning said sanding device 10 as discussed above when employed in conjunction with the power sanding machine 20.

The previous detailed description of the preferred embodiments of the present invention, is presented for purposes of clarity of understanding only, and no unnecessary limitations should be understood or implied therefrom, as all appropriate mechanical and functional equivalents to the above, which may be obvious to those skilled in the arts pertaining thereto, are considered to be encompassed within the claims of the present invention.

What is claimed is:

1. A conformable sending device comprising a block (18) formed of a resilient elastic material and having a predetermined shape; said block being flexible and deformable in response when such localized pressures are withdrawn; said block having two parallel flat major faces, and four connecting side edges extending between said flat faces; said block having a thickness dimension normal to its flat major faces; each flat major face of said block having a coating of abrasive materials thereon, whereby either flat face can be placed against a work surface for sanding and smoothing purposes; said block having a linear rectangular slot extending therethrough in a plane parallel to its flat major faces; said slot being located midway between the two flat major faces of the block; said slot having two edges thereof extending parallel and in near proximity to two of the block side edges; said slot having a width dimension parallel to the slot plane that is appreciably greater than one-half the distance between said two block side edges, whereby the slot appreciably reduces the stiffness of the block to a point where the block major flat faces can be readily reshaped and bent into concave or convex configurations by engagement with convex or concave work surfaces; said slot having a transverse thickness dimension normal to the slot plane; the thickness dimension of the resilient elastic block being several times the thickness dimension of said slot whereby the block has an appreciable thickness for ready gripment by a person's hand; and a flexible strap extendable through said slot; said strap having a width dimension essentially the same as the width dimension of the slot; said strap having a length dimension substantially greater than the length dimension of the slot, whereby when the strap is centrally positioned in the slot both end portions of the strap extend appreciable distances outwardly beyond selected side edges of said block; said block being adapted for positionment with either flat major face thereof abutting against the movable surface of an orbital sanding machine, and with the end portions of said strap clamped to the machine, whereby said block can be orbitally powered by the machine; and said resilient elastic block having an appreciable thickness dimension, so that when the block is attached to an orbital sanding machine its exposed flat major face can be significantly deformed by pressure contact with concave or convex work surfaces.

2. The sanding device of claim 1 wherein said flexible strap has a length dimension, such that when the strap is centrally positioned in the slot, each end portion of the strap extends outwardly beyond an associated edge of the block by a distance of approximately thirteen-sixteenths of an inch.

3. The sanding device of claim 2, wherein said flexible strap has a thickness dimension ranging from about one thirty-second of an inch to about one sixteenth of an inch.

4. The sanding device of claim 1, wherein said block has a thickness dimension of approximately thirteen sixteenth inch.

* * * * *